US005352013A

United States Patent [19]

Rusyniak

[11] Patent Number: 5,352,013

[45] **Date of Patent: * Oct. 4, 1994**

[54] COMBINATION TABLE AND LEG REST FOR RECLINING CHAIR

[76] Inventor: Michael F. Rusyniak, 9 Donald Pl., Liverpool, N.Y. 13090

[ * ] Notice: The portion of the term of this patent subsequent to Nov. 3, 2009 has been disclaimed.

[21] Appl. No.: 943,519

[22] Filed: Sep. 11, 1992

Related U.S. Application Data

[63] Continuation-in-part of Ser. No. 850,924, Mar. 13, 1992, Pat. No. 5,160,183.

[51] Int. Cl.[5] ..... A47C 7/52; A47C 7/68

[52] U.S. Cl. ..... 297/119; 297/68; 297/153; 297/423.1; 297/423.4

[58] Field of Search ..... 297/68, 83–85, 297/118, 119, 148, 153, 154, 423.1, 438, 423.26, 423.40

[56] References Cited

U.S. PATENT DOCUMENTS

| | | | |
|---|---|---|---|
| 684,844 | 10/1901 | Merker | 297/119 |
| 2,403,263 | 7/1946 | Collins | 297/119 |
| 3,084,975 | 4/1963 | Winrow | 297/119 |
| 3,635,522 | 1/1972 | Kernit | 297/153 |
| 4,621,863 | 11/1986 | Jackson et al. | 297/423 X |

*Primary Examiner*—Peter R. Brown
*Attorney, Agent, or Firm*—Harris Beach & Wilcox

[57] ABSTRACT

Combination self-storing table/leg rest for a reclining chair is shown in which a hinged table top is hooked onto a leg rest frame member and covered with a padded upholstered cushion to match the decor of the reclining chair. A pin is mounted on the underside of the folded table and is adapted to fit into a receptacle formed in the end of an arm of the reclining chair for positioning the table in convenient position for use by a person sitting in the chair. The table when used rests on the second arm of the chair, or it may be pivoted to allow ingress and egress to the chair.

14 Claims, 4 Drawing Sheets

COMBINATION TABLE AND LEG REST FOR RECLINING CHAIR

This application is a continuation-in-part of U.S. patent application Ser. No. 850,924 filed Mar. 13, 1992 for COMBINATION TABLE AND LEG REST FOR RECLINING CHAIR and issued as U.S. Pat. No. 5,160,183 on Nov. 3, 1992.

BACKGROUND OF THE INVENTION

This invention relates to a table for use with a reclining chair and more particularly to a self-storing folding table which also functions as a leg rest for a reclining chair.

Frequently, when seated in a chair, it is desirable to have a flat table surface upon which the seated person may write, eat, or perform other activities. Various table arrangements for use with chairs are known in the prior art. These include the folding arm chair used in educational institutions and the typical tray table inserted in the arm rests of airline seats. In addition, very involved folding combination leg rest and table arrangements such as those shown in U.S. Pat. Nos. 2,403,263 and 2,555,144 have also been proposed.

All of these table/chair combinations have severe limitations, especially if they are to be used in the family or formal areas of the home. These problems include the complexity and cost of the construction shown in the cited patents, the lack of storage space for the airline tray configuration, and the poor aesthetics of the folding arm configuration.

In addition some configurations, such as the airline type, do not allow a person ingress and egress to the seat when the table is being used. This detracts considerably from the functionality of the table because the table must be removed each time ingress or egress is sought. In addition, there may be difficulty in utilizing the table for some applications, as for example, as a resting place for an open container filled with a liquid. If such items are placed on the table before the user is seated, placing the table on the chair may result in spilling. Yet it is difficult to place such items on the table once the user is seated, because the reach of the person using the table is severely limited due to the table being in place.

OBJECTS AND SUMMARY OF THE INVENTION

Accordingly, it is an object of the present invention to provide an improved, aesthetic combination table and footrest for reclining chairs.

It is another object of the present invention to provide a combination table and footrest for reclining chairs that is self storable in the chair in a pleasing and simple manner.

It is another object of the present invention to provide a folding table that forms an integral part of a reclining chair, but can be selectively removed, opened and positioned to form a large, flat table surface for use therewith.

It is a still further object of the present invention to provide a combination folding table and leg rest for a reclining chair that can be used by a person seated in the chair, whether in the upright or the reclined position.

It is yet another object of the present invention to provide a combination folding table and leg rest for a reclining chair wherein the table may be pivoted out of the way while in use to allow ingress and egress to the chair.

These and other and further objects of the present invention are accomplished by a reclining chair wherein the usual reclining chair footrest is replaced by a base member on which is detachably positioned a folding table which is covered by a pad and decorative leg rest which form an integral part of the chair when the table is not in use. The table may be pivoted in a horizontal plane about a single pin in order to allow the user ingress and egress to the chair.

BRIEF DESCRIPTION OF THE DRAWINGS

These and other and further objects of the present invention will be apparent from a description of the invention, taken in conjunction with the drawings wherein.

DETAILED DESCRIPTION OF THE INVENTION

Figure 1:
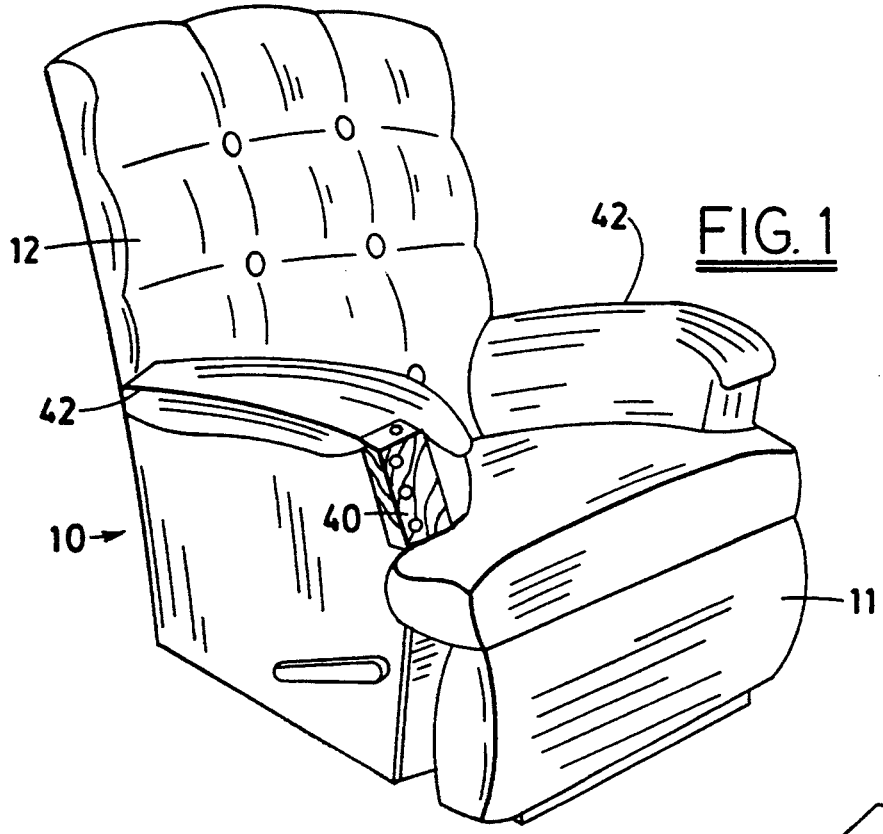
FIG. 1 is a perspective view of a chair in accordance with the present invention.

Referring now to FIG. 1 the chair 10, according to the present invention has a back 12 and arms 42—42. When not in the reclining position, the chair has the appearance of an overstuffed chair. When the back 12 is made to recline in the usual fashion, leg rest extends outwardly and upwardly at the front of the chair to support the legs of a person reclining in the chair. The leg rest of the present invention is shown in partially exploded form in FIG. 2 wherein it can be seen that the overall leg rest assembly 11 is supported on a pair of hinged scissor arms 20 extending from the front bottom of the chair 15 to the leg rest assembly 11. The leg rest assembly 11 consists of a table assembly 14 covered by a padded cushion 18.

Figure 5:
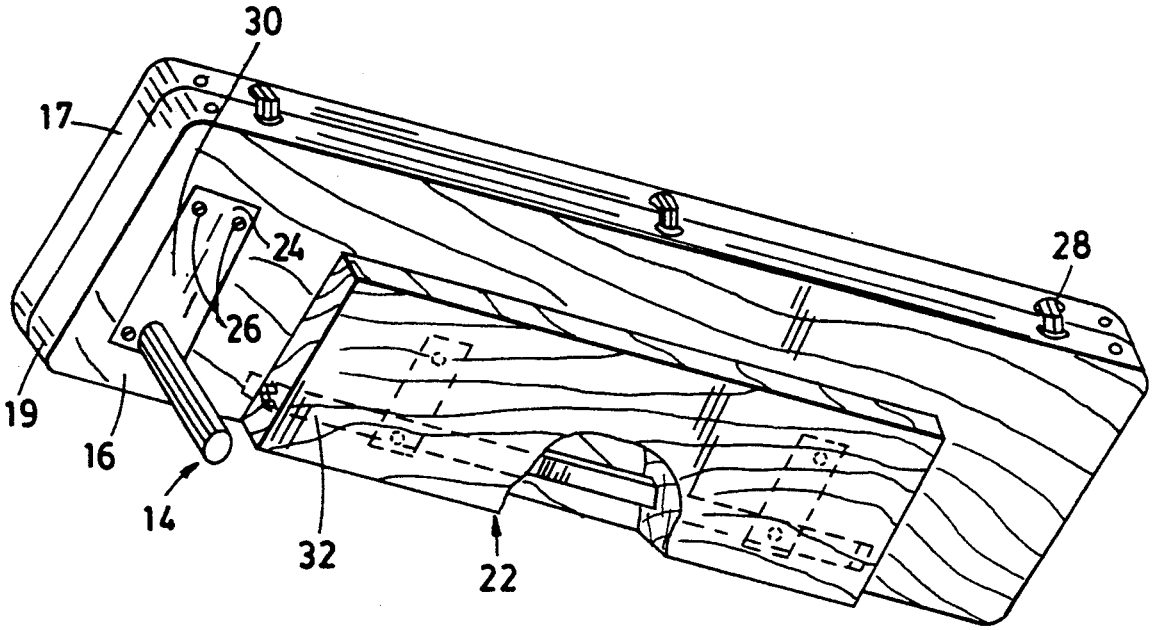
FIG. 5 is a bottom perspective view of the table assembly and base member for a first embodiment of the chair.
Figure 6:
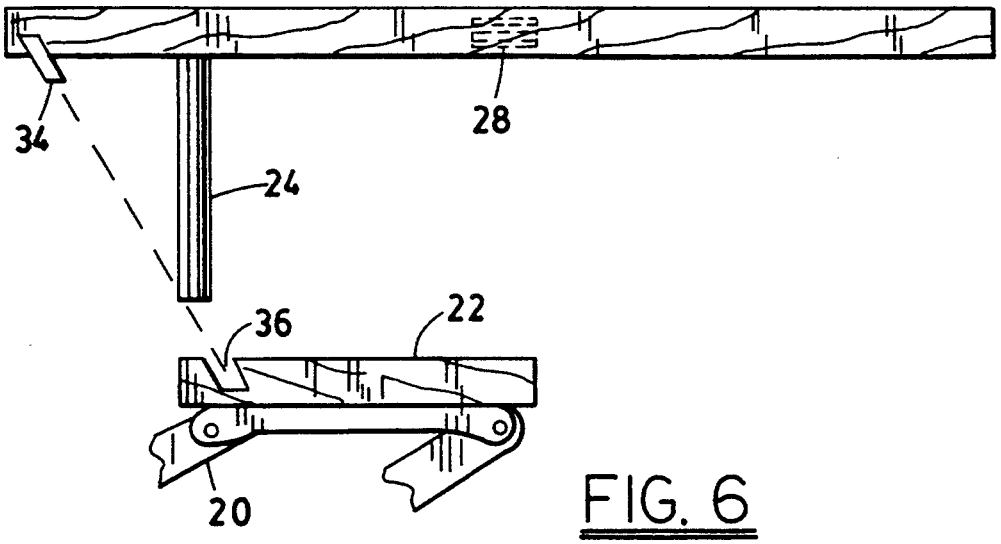
FIG. 6 is a cross-section in exploded form similar to FIG. 4.
Figure 7:
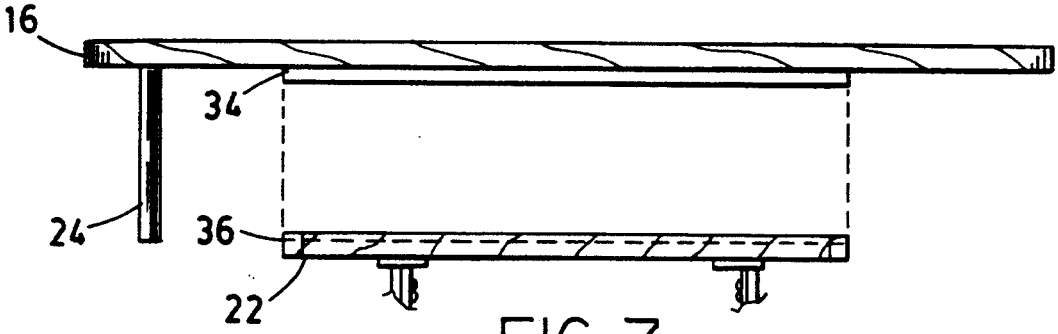
FIG. 7 is a front elevation of the table and the base.

As may be seen in FIGS. 5, 6 and 7, the table assembly 14 is detachably secured to the base member 22 by a long cleat 34 which is mortised into the bottom surface of the panel 17. The cleat 34 is adapted to be positioned in a slot 36 in the upper surface of the base member 22. The slot 36 is positioned near the top of the base member when the base member is in the retracted position. Slot 36 extends from end to end of the base member 22 and cleat 34 is mortised has a length substantially the same as slot 36. As can be seen, the cleat 34 is angled at approximately a forty-five degree angle with the under surface of panel 17 so that, when inserted in the slot, the table assembly is supported by the base member 22, even when the leg rest assembly is in the retracted position of FIG. 1. This construction also tends to secure the table assembly in proper position if the table is opened while vertically supported by the base member as in FIG. 6. While, as can be seen in FIG. 7, the base member 22 has a width substantially less than the table 16 width when the table assembly 14 is removed the base member 22 still will provide some leg support when in the raised position, as indicated in FIGS. 7 and 10.

Referring now to FIG. 5 it can be seen that the leg rest assembly 11 comprises the base member 22 and the table assembly 14. Table 16 of the table assembly 14 is Formed from two rectangular panels 17 and 19 hinged along one edge by barrel hinges 28—28 and folded together to form an extended leg rest platform. A single L-shaped support pin 24 is affixed perpendicular to and mounted on the underside of one-half of the table 16, via a flush bracket 30, part of the L-shaped support pin 24, which bracket is affixed via screws 26 or the like. When the folded table 16 is suspended from the base member 22, the foot rest assembly 11 can be retracted to the position shown in FIG. 1 as the support pin 24 slips into the hole 13 (see FIG. 2) from which the hinged scissor arms 20 protrude.

Figure 8:
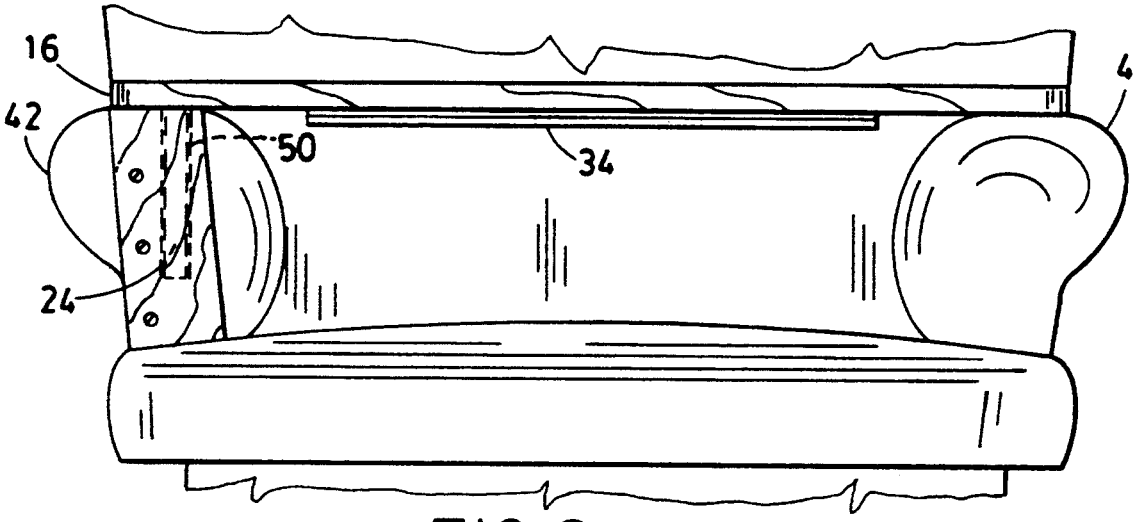
FIG. 8 is a front view of the table of the first embodiment of the present invention mounted on the chair of FIG. 1.
Figure 9:
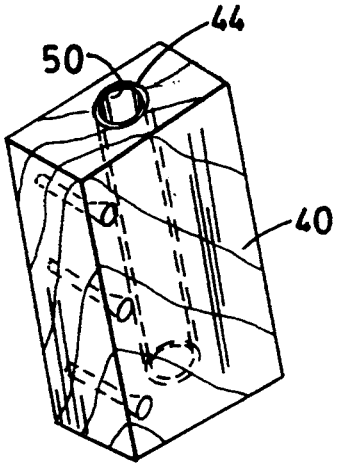
FIG. 9 is a perspective detail of the mounting receptacle for the table pin.
Figure 10:
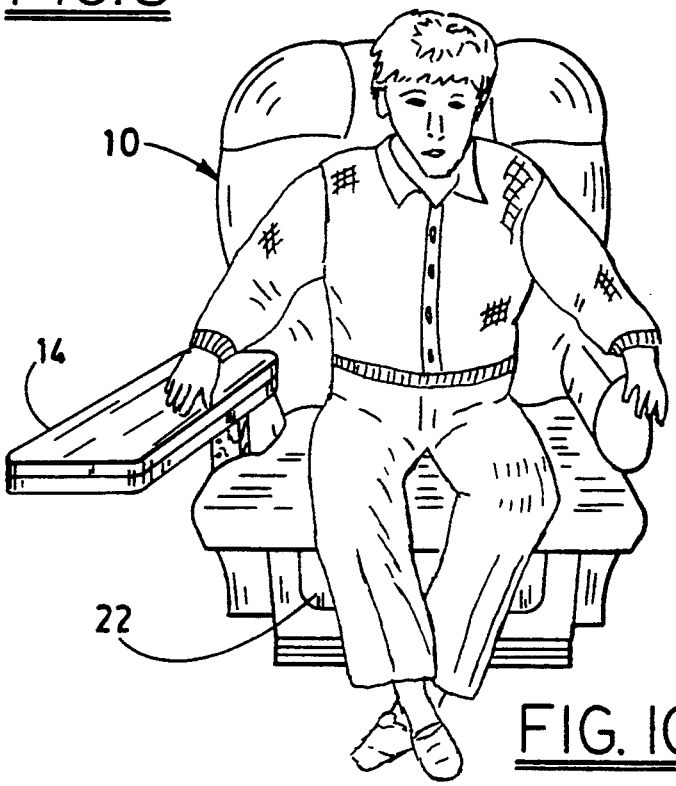
FIG. 10 is a perspective view of a person seated in the chair with the table installed, and pivoted to allow the user ingress and egress.

Referring now to FIGS. 8 and 10, it can be seen that this support pin 24 is designed to fit inside the receptacle block 40 which is mounted on the front edge of one arm 42 (shown as the right arm) of the chair 10. The block 40 has formed therein a hole 44 which is generally vertical and is sized to receive therein the support pin 24. A bushing 50 of plastic or like material may be placed inside this hole in order to protect the wood of the block and to allow easier pivoting of the pin when appropriate. While the block 40 is shown in an exposed condition in the present drawings for clarity of explanation, the block normally would be covered as part of the decorative finish of the chair with only the top opening of the hole 44 showing for positioning of the table support pin 24 when the table 16 is mounted in the position shown in FIG. 10, so as to provide a work surface for a person seated in the chair 10.

When the table 16 is in use by a person seated in the chair 10, the table 16 is not only detachably affixed to one chair arm 42 but in addition, as shown in FIG. 10, the side of the table that does not contain the support pin 24, rests atop the second chair arm 48 (shown as the left arm) for added stability. The table 16, can be pivoted aside while still in the horizontal position, with support pin 24 in hole 44, so that the table is supported only by support pin 24. When the table 16 is so positioned a person may easily be afforded ingress and egress to the chair without disturbing the articles resting on the surface of the table 16.

It will thus be seen that this invention provides a combination table and leg rest for a reclining chair where the table can be unfolded and installed across the arms of the chair to provide a large working surface. In the self-stored position secured to the base member of the leg rest and covered with the padded cushion, the table appears as an ordinary leg rest for a overstuffed reclining chair. The construction is simple and economical to accomplish yet provides a very practical and rugged table assembly. Furthermore, the table can be pivoted out of the way when in use to allow ingress and egress to the chair.

Figure 2:
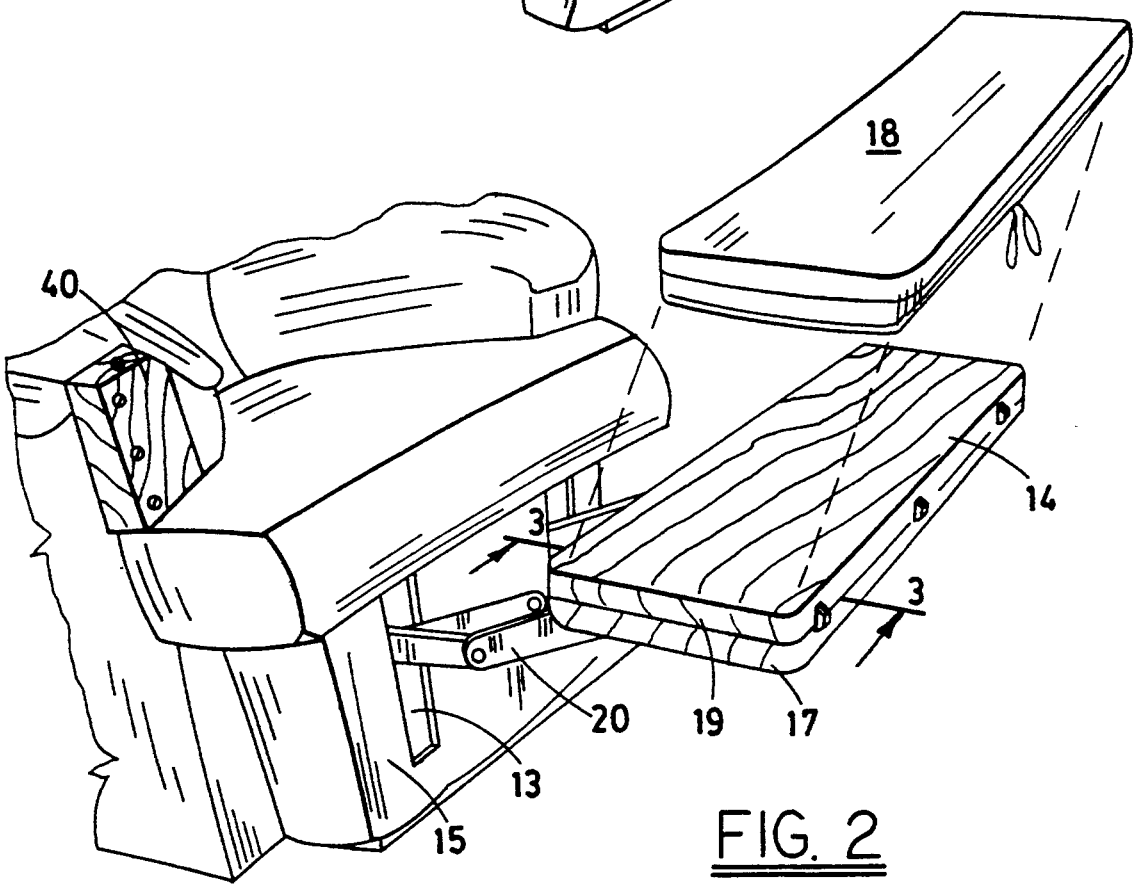
FIG. 2 is a partial perspective view of the leg rest of the present invention with the cushioned cover shown partially removed.
Figure 3:
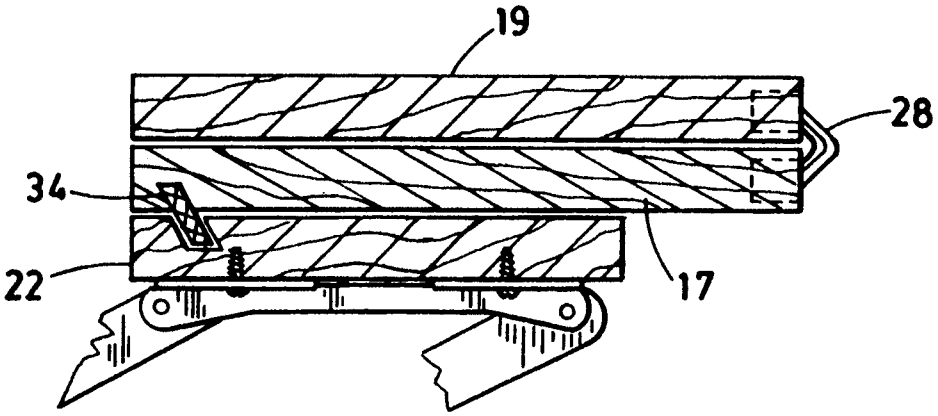
FIG. 3 is a detail view of the mounting of the folded table on the base member.
Figure 4:
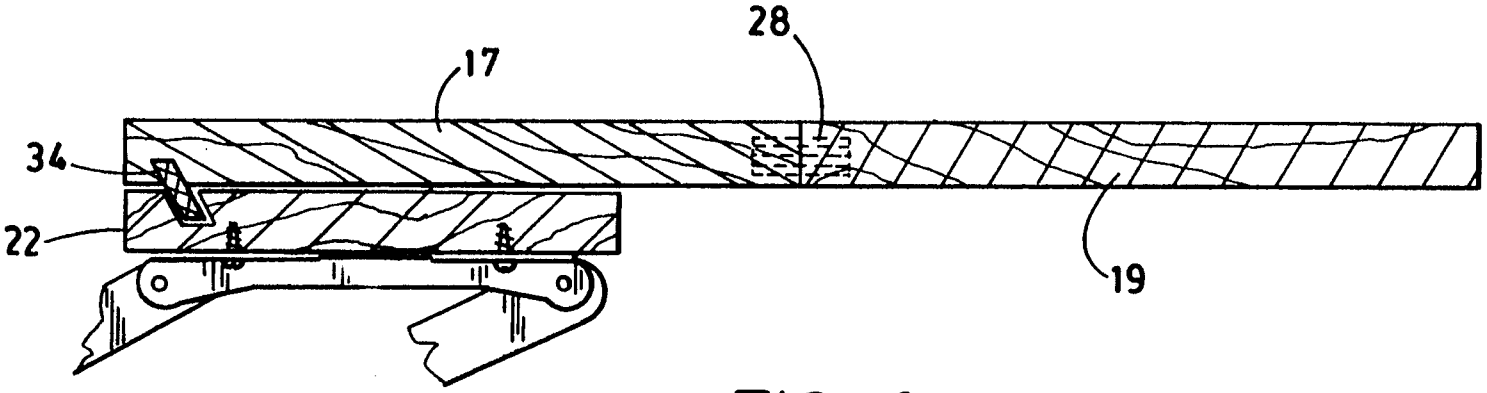
FIG. 4 is a view similar to FIG. 3 with the table in the unfolded position.

While the padded cover 18 is shown as a separate piece, obviously, it could take other forms, such as a decorative pad affixed to the top surface of the panel 19 in FIG. 2. This pad would not adversely interfere with the legs of the person sitting in the chair even when the table 16 is unfolded.

While this invention has been explained with reference to the structure disclosed herein, it is not confined to the details set forth and this application is intended to cover any modifications and changes as may come within the scope of the following claims:

What is claimed is:

1. In a reclining chair having two arms and a leg rest movable from a retracted position to an extended position, a combination table and leg rest which comprises:

a base member mounted on extendable chair frame members foe movement from a retracted to an extended position;

a table assembly detachably mounted on said base member;

means for detachably mounting said table assembly on said base member;

support means for firmly supporting said table assembly on one arm of said reclining chair, said support means further comprising:

a pin affixed to the underside of one side of said table assembly; and a receptacle fixed in one arm of said reclining chair, said receptacle being sized to receive therein said pin when said table assembly is being used as a table, so that said table assembly may be selectively removed from said base member and placed on said support means to form a generally horizontal table surface for the use of a person seated in the reclining chair, in said table assembly is adapted to being pivoted in a horizontal plane to allow a user ingress and egress to said chair.

2. In a reclining chair having two arms and a leg rest movable from a retracted position to an extended position, a combination table and leg rest which comprises:

a base member mounted on extendable chair frame members for movement from a retracted to an extended position;

a table assembly detachably mounted on said base member; and support means for supporting said table assembly on the arm of said reclining chair, said support means comprising a pin affixed to the underside of one side of said table assembly and a receptacle fixed in one arm of said reclining chair, said receptacle being sized to receive therein said pin when said table assembly is being used as a table;

so that said table assembly may be selectively removed from said base member and placed on said support means to form a generally horizontal table surface for the use of a person seated in the reclining chair and said table assembly may be pivoted in a horizontal plane to allow a user ingress and egress to said chair.

3. The apparatus of claim 2 wherein a second side of the table assembly rests flush against the second arm of said reclining chair when said table assembly is being used as a table by a person seated in the chair.

4. The apparatus of claim 3 wherein said pin is perpendicular to the plane of said table and fits in a recess in the bottom front portion of said chair when said leg rest is in a contracted position.

5. The apparatus of claim 3 including a padded cover sized to fit about said table assembly when said table assembly is mounted on said base member to form together a padded leg rest for a reclining chair.

6. The apparatus of claim 3 wherein said table assembly comprises two panels hinged together along one edge so as to form when opened out a table approximately twice as wide as the width of a leg rest on which it is to be positioned.

7. The apparatus of claim 3 wherein said table assembly is padded on one surface to form a comfortable leg rest when mounted on said base member.

8. The apparatus of claim 3 wherein said pin comprise a metal tube and said receptacle comprises a cylindrical hole located in one arm of a reclining chair.

9. The apparatus of claim 3 wherein said base member is of a size to function as a leg support when said table assembly is functioning as a table.

10. The apparatus of claim 3 wherein said means for detachably mounting said table assembly on said base member consists of said table assembly having at least one male interlocking means extending outwardly from the surface thereof, positioned adjacent one edge of said table assembly and inclined toward the other edge; and said base member having formed therein at least one female interlocking means aligned with and sized to receive therein said male interlocking means;

so that when said base member is in a vertical position said table assembly may be suspended thereon for self storage.

11. The apparatus of claim 10 wherein said at least one male interlocking means comprises an elongated cleat fixed to said table assembly and said at least one female interlocking means in said base member comprise an elongated slot formed to receive therein said cleat.

12. The apparatus of claim 11 wherein said cleat and slot are formed at an angle of approximately 45° from the plane of said table and base member.

13. The apparatus of claim 2 wherein said receptacle contains therein a bushing to allow said pin to pivot easily.

14. In a reclining chair having two arms and a leg rest movable from a retracted position to an extended position, a combination table and leg rest which comprises:

a base member mounted on extendable chair frame members for movement from a retracted to an extended position;

a table assembly detachably mounted on said base member;

means for detachably mounting said table assembly on said base member;

retaining means located on said table assembly for rotatably retaining a first end of said table assembly to a first arm of said reclining chair; and accepting means located on said first arm for engaging said retaining means;

wherein a second end of said table assembly is adapted to rest on a second arm of said reclining chair so that said table assembly may be selectively removed from said base member and placed on said support and retaining means to form a generally horizontal table surface for the use of a person seated in the reclining chair.

* * * * *